US008421570B2

(12) United States Patent
Schwander et al.

(10) Patent No.: US 8,421,570 B2
(45) Date of Patent: Apr. 16, 2013

(54) ROTATING TRANSFORMER

(75) Inventors: Denis Schwander, Labarthe sur Leze (FR); Michel Privat, Caignac (FR); Francois Dugue, Pompertuzat (FR); Daniel Sadarnac, Bures sur Yvette (FR)

(73) Assignee: Centre National d'Etudes Spatiales, Paris (FR)

( * ) Notice: Subject to any disclaimer, the term of this patent is extended or adjusted under 35 U.S.C. 154(b) by 719 days.

(21) Appl. No.: 12/084,034

(22) PCT Filed: Oct. 24, 2006

(86) PCT No.: PCT/FR2006/002387

§ 371 (c)(1), (2), (4) Date: Jul. 29, 2009

(87) PCT Pub. No.: WO2007/048920

PCT Pub. Date: May 3, 2007

(65) Prior Publication Data

US 2009/0295523 A1 Dec. 3, 2009

(30) Foreign Application Priority Data

Oct. 27, 2005 (FR) ..... 05 10985

(51) Int. Cl.
*H01F 21/06* (2006.01)
*H01F 21/04* (2006.01)

(52) U.S. Cl.
USPC ..... 336/130; 336/118; 336/119; 336/124

(58) Field of Classification Search ..... 336/130, 336/118, 119, 124
See application file for complete search history.

(56) References Cited

U.S. PATENT DOCUMENTS

| | | | | |
|---|---|---|---|---|
| 4,079,324 | A | 3/1978 | Chesnel | |
| 6,333,581 | B1 * | 12/2001 | Kohl et al. | 310/263 |
| 2002/0157849 | A1 | 10/2002 | Sakata | |
| 2004/0244474 | A1 * | 12/2004 | Fennel et al. | 73/146 |

FOREIGN PATENT DOCUMENTS

| | | | |
|---|---|---|---|
| DE | 2 234 472 | | 1/1974 |
| DE | 100 39 398 | A1 | 2/2002 |
| DE | 20 2004 016 751 | U1 | 1/2005 |
| EP | 0 520 535 | A1 | 12/1992 |
| FR | 2 521 766 | | 8/1983 |
| WO | WO 2006/045274 | A1 | 5/2006 |

* cited by examiner

*Primary Examiner* — Mohamad Musleh
*Assistant Examiner* — Ronald Hinson
(74) *Attorney, Agent, or Firm* — Jacobson Holman PLLC

(57) ABSTRACT

The transformer ensures the transmission of electrical power by electromagnetic induction between the first (11) and second (12) coils concentrically arranged on the first (7) and second (8) tubular parts respectively, which are made of a ferromagnetic material, and coaxially mounted in such a way that an outer surface (13*a*, 13*b*, 13*c*) of one part can rotate in relation to an inner surface (14*a*, 14*b*, 14*c*) of the other. These surfaces each consist of two straight cylindrical rotation surfaces (13*a*, 13*c*; 14*a*, 14*c*) of different diameters, each extending from one of the axial ends of the part (7; 8) to an intermediate radial shoulder (13*b*, 14*b*) for connecting these surfaces. The parts (7; 8) are arranged head-to-foot one inside the other so as to delimit, between the shoulders (13*b*; 14*b*), an annular space receiving the coils (11, 12), between two annular gaps each delimited by two (13*a*, 14*a*; 13*b*, 14*b*) of the facing cylindrical surfaces of the first (7) and second (8) parts. Each coil comprises at least one layer of a plurality of strip-like windings.

10 Claims, 3 Drawing Sheets

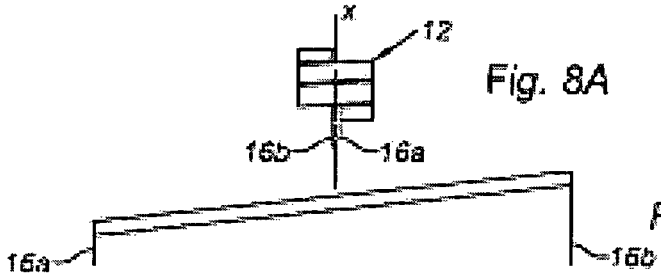
Fig. 8A
Fig. 8B
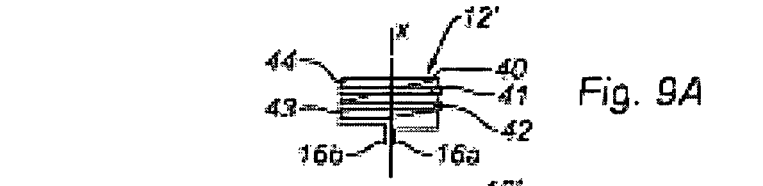
Fig. 9A
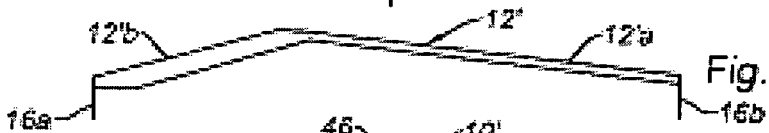
Fig. 9B
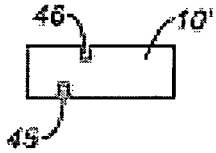
Fig. 9C
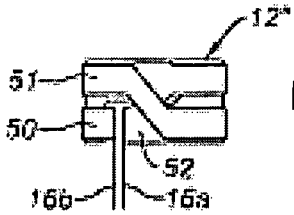
Fig. 10A
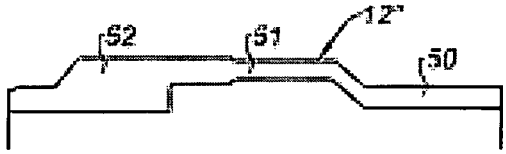
Fig. 10B
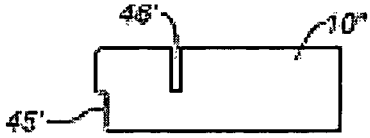
Fig. 10C

ROTATING TRANSFORMER

This is a national stage of PCT/FR2006/002387 filed Oct. 24, 2006 and published in French.

The present invention relates to a rotary transformer for the transmission of electrical power by electromagnetic induction between the first and second coils concentrically arranged on the first and second tubular parts respectively, which are made of a ferromagnetic material and coaxially mounted in such a way that the outer surface of one part can rotate in relation to the inner surface of the other. The present invention also relates to a process for manufacturing this transformer and to devices for the supply of electrical power comprising such a transformer.

Such a rotary transformer, or transmitter, is used in particular in electric machines with an excited rotor, particularly in synchronous generators where it replaces a conventional friction-brush commutator. It enables an excitation current to be transmitted to the generator rotor without making physical contact therewith, and therefore without being affected by wear which results in damage to the brushes of a conventional commutator.

FIGS. 1 and 2 of the accompanying drawings are a schematic representation of known types of rotary transformers. That shown in FIG. 1 basically comprises two parts 1 and 2 in the form of an annular ring, mounted concentrically so that one can turn in relation to the other about a common axis X, the parts 1 and 2 having hollowed-out annular grooves 3 and 4 respectively in which electric coils 5 and 6 are housed respectively. The inner diameter of the part 1 is slightly larger than the outer diameter of the part 2 so that the latter can rotate inside the part 1 without making physical contact therewith. Gaps, usually measuring approximately 0.1 mm, are thus created around the coils. Said coils are wound directly onto the parts 1 and 2 which are made of a magnetic material such as a ferrite.

In a variant, as shown in FIG. 2, a transformer is also known that comprises two rings 1' and 2' rotatably movable about the same axis X', two facing axial ends of these rings having two hollowed-out annular grooves 3' and 4' respectively, housing the coils 5' and 6' respectively. The gaps created around the coils are therefore radial.

One of the industries that can benefit from the use of rotary transformers notably includes the space industry, for example to transmit, in a satellite, an electrical power current to a measuring instrument mounted on a support plate with a rotary joint enabling it to be positioned in relation to the stars. The elimination of the conventional friction-brush commutator and its replacement by such a transformer would in fact render the equipment more reliable by eliminating the risk of failure due to brush wear. This application is, however, hindered by the limitations of the known transformers described above with regard to FIGS. 1 and 2.

In fact, it is difficult to machine the grooves that house the coils with the precision required by the space industry. It is awkward to fit these coils, particularly in the case of the transformer shown in FIG. 1, since they must be wound directly onto the parts that support them. The fact that the windings are wound in superimposed layers results in leakage inductance and considerable losses. Furthermore, the complex geometry of the cores of these transformers means that the gap and associated section is not easy to control. This results in lower magnetisation inductance which must therefore be compensated for by oversizing. Lastly, known rotary transformers do not lend themselves to use in conventional PWM converters because their leakage inductance is too high.

The object of the present invention is precisely to create a rotary transformer which is not affected by the above-mentioned limitations.

This object of the invention, as well as others which will emerge from the following description, is achieved by a rotary transformer for the transmission of electrical power by electromagnetic induction between the first and second coils concentrically arranged on first and second tubular parts respectively, which are made of a ferromagnetic material and coaxially mounted in such a way that the outer surface of one part can rotate in relation to the inner surface of the other, this transformer being remarkable in that these surfaces are each composed of two straight cylindrical rotatable surfaces of different diameters, each extending from one of the axial ends of the part to an intermediate radial shoulder for connecting these surfaces, the parts being arranged head-to-foot one inside the other so as to delimit, between the shoulders, an annular space receiving the coils, between two annular gaps each delimited by two facing cylindrical surfaces of the first and second parts.

As will be seen in more detail below, the simple geometry of these parts, having no groove, means that they can be manufactured with the precision required by the space industry. It also enables pre-prepared coils to be fitted simply onto these parts.

According to other characteristics of the present invention:

- at least one of the coils has at least one layer of a plurality of strip-like windings;
- each of the coils has only one layer of strip-like windings, according one particular embodiment of the invention;
- this layer of windings is fitted onto the part that carries it by means of a ring made of an insulating material;
- the layer of windings is covered externally by a layer of insulating material;
- in a variant, at least one of the coils has two superimposed layers of windings, inner and outer respectively, the inner layer having a smaller number of windings than the outer layer, the total axial extensions of the two layers being substantially identical;
- the ratio of the axial lengths of the two gaps is the inverse of that of their diameters;
- one of the tubular parts is mounted rotatably within the other by means of a shaft which passes axially through it, said shaft having a chamfered root fitting in a complementary manner into a chamfer made in said part;
- the clearance separating the facing coils is between 0.3 and 0.5 mm, typically 0.4 mm;
- the tubular parts are made of ferrite.

The invention also provides a process for the manufacture of this rotary transformer according to which a) the first and second tubular parts made of ferromagnetic material are manufactured and configured in such a way that one can rotate within the other and b) coils are manufactured, at least one of them comprising at least one layer of a plurality of strip-like windings and c) each of the coils are fitted onto the corresponding tubular part by passing it onto said part parallel to the axis of this tubular part.

As will be seen below, this particularly simple assembly facilitates the manufacture of the transformer according to the invention.

According to other characteristics of this process:

- in order to manufacture the coil, a metal ring is mounted on an annular support made of an insulating material;
- a coil is formed in the material of the ring thus mounted, by mechanical machining or by chemical etching;
- the coil obtained is mechanically ground and covered with a layer of insulating material;

in a variant, the coil is manufactured by being cut out of a metal sheet.

The present invention also provides an electrical power supply device for an instrument mounted on a rotary plate, comprising means of transmitting this power without physical contact between the plate and a support thereof, these means comprising a rotary transformer according to the invention, the rotary tubular part of the transformer being integral in rotation with the plate.

Applications for such a device are found particularly in the space industry, as will be seen below.

Further features and advantages of the invention will emerge from the following description and accompanying drawings in which:

FIGS. 1 and 2 schematically represent rotary transformers of the prior art, described in the preamble of the present description;

FIG. 3 schematically represents, in axial section, a rotary transformer according to the invention;

FIGS. 8A to 10C represent three embodiments of a coil of a rotary transformer according to the invention.

Figure 1:
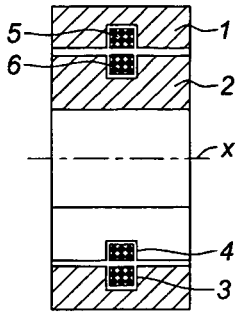
Fig. 1 (Prior art)
Figure 2:
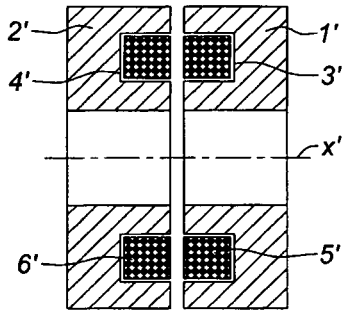
Fig. 2 (Prior art)
Figure 3:
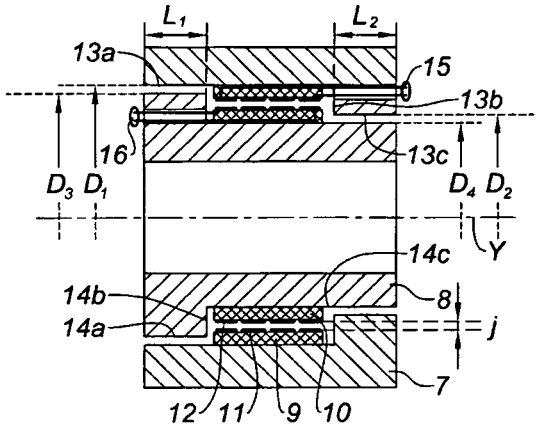

Referring to FIG. 3 of the accompanying drawings which shows that the rotary transformer according to the invention illustrated in this figure basically comprises the first and second tubular parts 7 and 8 respectively carrying the first and second rings 9 and 10 respectively, themselves supporting the first and second coils 11 and 12 respectively. These coils, of different diameters, are of a particular type which will later be described in detail. They are mounted concentrically and coaxially inside each other around an axis Y, like the tubular parts 7 and 8 that support them. As shown, these parts 7 and 8 have an inner surface 13*a*, 13*b*, 13*c* and an outer surface 14*a*, 14*b*, 14*c* respectively, arranged so as to be able to rotate facing each other about the axis Y.

These parts are made of a ferromagnetic material, advantageously by moulding a ferrite, optionally followed by simple machining of the surfaces 13*a*, 13*c*, 14*a*, 14*c* which precisely determines the value of the gap. The rings 9 and 10 supporting the coils 11 and 12 are made of an electrically insulating material.

According to the present invention, the above-mentioned inner and outer surfaces each consist of two straight cylindrical rotation surfaces 13*a*, 13*c* and 14*a*, 14*c* respectively, separated by a radial shoulder 13*b*, 14*b* respectively. The diameters D1 and D3 of the surfaces 13*a* and 14*a* respectively are larger than the diameters D2 and D4 of the surfaces 13*c* and 14*c* respectively. Similarly, the diameters D1 and D2 are slightly larger than the diameters D3 and D4 respectively so as to create two narrow gaps between the surfaces 13*a* and 14*a* on the one hand and between the surfaces 13*c* and 14*c* on the other, the widths of these gaps being exaggerated to make the figure clearer.

The width of the gaps could be set at a very small value, up to 0.06 mm for example. This width could, however, be adjusted to a larger value, depending on the magnetic characteristics to be given to the transformer.

As shown in FIG. 3, each of the above-mentioned straight cylindrical surfaces extends from one axial end of the part 7, 8 on which it is formed up until the intermediate radial shoulder 13*b*, 14*b*, respectively. The axial lengths of the two parts 7 and 8 may be substantially equal, as shown. The shoulders 13*b*, 14*b* are arranged, between the ends of the parts 7 and 8 respectively, in non-central axial positions. Thus, when the parts 7 and 8 pass concentrically, head to foot, one inside the other as shown, the shoulders 13*b* and 14*b* delimit the axial extension of an annular space in which the coils 11 and 12 are housed together with the rings 9 and 10 supporting these coils, respectively.

The above-described geometry of the tubular parts 7 and 8 has several advantages compared to the known geometries of the prior art. Firstly, this geometry does not involve annular grooves, difficult to create with precision, to house the coils. These grooves are replaced by two shoulders 13*b*, 14*b* each formed on one of the two parts, these shoulders being much easier to create with precision than grooves.

Secondly, this geometry enables the coils to be manufactured separately then fitted onto the tubular parts simply by sliding them onto the latter, parallel to the axes of these parts, from one axial end of the part, until each coil and its supporting ring abut the corresponding shoulder, as will be seen later in the description of the embodiments of the rotary transformer according to the invention shown in FIGS. 4 and 5.

Thirdly, as will also be seen in the following description of the process for manufacturing the transformer according to the invention, manufacturing the coils separately enables them to be given a configuration that minimises the leakage inductance of the transformer, and therefore the related power losses, in accordance with one of the objects of the present invention.

In order to manufacture these coils, a metal ring, made of copper for example, is mounted and glued onto the inner surface of the insulating ring 9 and another such ring on the outer surface of the ring 10. Pairs of electrical supply wires 15 and 16 are brazed onto the metal rings carried by the insulating rings 9 and 10 respectively.

A coil is then formed inside these rings by mechanical machining or by a well-known photochemical etching process. The surfaces of the coils thus obtained are then mechanically ground and finally protected by applying a layer of insulating material, in the form of a varnish for example.

These coils are then mounted on the parts 7 and 8, themselves obtained, for instance, by moulding a ferromagnetic material such as a ferrite. To achieve this, according to a characteristic of the present invention, each coil is conveniently passed onto the corresponding part by sliding it along the axis Y thereof. The pairs of wires 15 and 16 are simultaneously passed through the corresponding passages provided in the parts 9 and 10 in such a way that they cross the shoulder areas of these parts and can be accessed at one axial end thereof. Finally, the coil support rings are fixed onto these parts, by gluing them into the shoulder area thereof.

Figure 4:
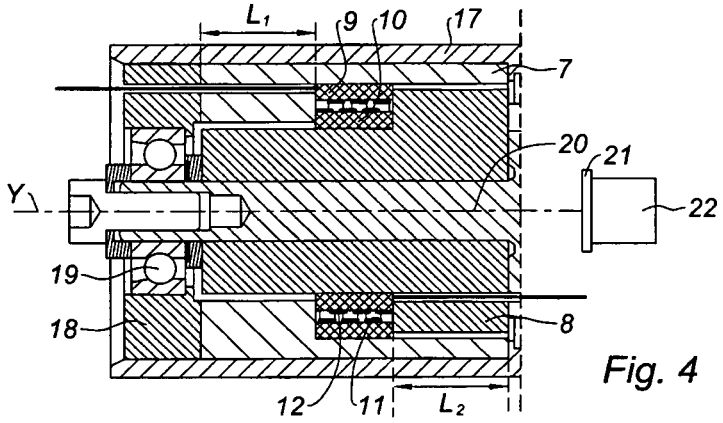
FIGS. 4 and 5 represent, in axial section, two embodiments of the transformer illustrated in FIG. 3.
Figure 5:
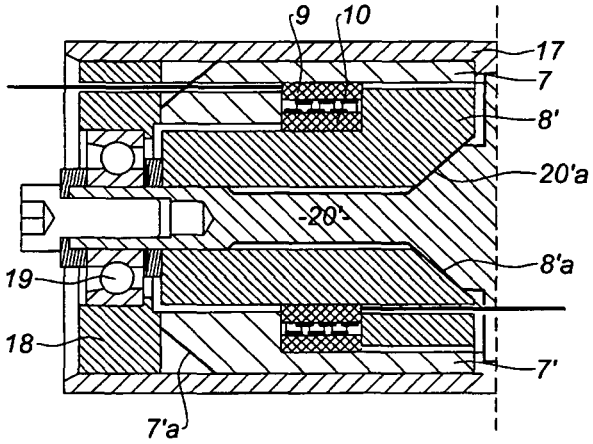

FIGS. 4 and 5 of the accompanying drawings represent two embodiments of the rotary transformer obtained by adopting the manufacturing process according to the invention. In these figures, reference numerals, possibly marked with a "prime", which are identical to the reference numerals in FIG. 3, indicate identical or similar parts.

In the embodiment shown in FIG. 4, the parts 7 and 8 are mounted coaxially in a cylindrical casing 17 closed at one end by an annular base 18 centrally supporting a ball bearing 19. A shaft 20 supported by this bearing passes axially through the part 8 in such a way that said part 8 can rotate inside the part 7, itself integral with the casing 17. The parts 7 and 8 therefore constitute the stator and the rotor respectively of the rotary transformer shown.

FIG. 4 shows that the rings 9 and 10 are resting against the shoulders of the parts that carry them, which makes it easy to position them accurately when fitting them onto the parts 7 and 8.

It is also shown that the coils 11 and 12 have a very narrow radial thickness, of between 0.1 mm and 0.5 mm, typically 0.3 mm for a transformer with a power of 30 W operating at 100 kHz. They are also arranged very close to each other. Thus the magnetic flow created by one of them passes practically entirely into the other. This arrangement enables the leakage inductance of the transformer to be reduced to a minimum, in accordance with one of the objects of the present invention. This result is achieved by using coils which comprise only one layer of a plurality of windings, separated by a very small clearance j (see FIG. 3), of between 0.3 mm and 0.5 mm, typically, 0.4 mm, manufactured using the above-described process. The conductor that makes up each winding takes the form of a very thin strip.

In a variant of this embodiment of the invention, each coil can be made as shown in FIGS. 8A and 8B which represent such a coil 12 (or 11), with an axis X in FIG. 8A, and the same coil unwound in a plane in FIG. 8B. This coil is cut from a metal sheet, copper for instance, in the shape of an elongated oblique parallelogram shown in FIG. 8B. This shape allows the copper strip thus cut to be wound in a spiral on a mandrel so as to form the coil shown in FIG. 8A. Before this winding process, supply wires 16*a*, 16*b* (in the case of a rotor coil for example) are brazed to the ends of the strip. After winding, these wires are side by side (as shown in FIG. 8A) to minimise leakage inductance, the long side of the parallelogram shown in FIG. 8B being substantially triple the length of one coil winding.

It will be observed that the two gaps located axially either side of the coils 11 and 12 are positioned at different radial distances from the axis Y and may have the same or different axial extensions. Advantageously, their magnetic resistances will be balanced by giving them the same surface areas. To do this, the ratio of their axial lengths L1 and L2 must be inversely equal to that of their diameters D1 and D2, respectively (see FIG. 3). For the above-mentioned 30 W transformer, L1 may be approximately 15 mm and L2 approximately 10 mm.

The embodiment shown in FIG. 5 differs from that shown in FIG. 4 basically in that the shaft 20' which supports the part 8' rotatably in the part 7' has a chamfered root 20'*a* engaged against a complementary chamfer 8'*a* formed in said part 8'. The part 7' also has an annular chamfer 7'*a* at its larger end. These arrangements reduce the volume and mass of the parts 7' and 8'. They improve the mechanical strength of the part 8' (the rotor) by reducing the stress due to the differential expansion of the shaft 20' that carries it.

In a variant of the above-described embodiments of the invention, with a single layer of a plurality of windings, the rotary transformer may be fitted with coils having a plurality of layers of windings, each winding (called a "plate") again having the form of a thin strip.

FIG. 9A (similar to FIG. 8A) thus shows a coil 12' designed to be supported by the rotating part (rotor) of the transformer according to the invention. FIGS. 9B and 9C respectively show this coil and an insulating sheet arranged between the layers of coil windings unwound in one plane.

As shown, this coil comprises one outer layer of three windings 40, 41 and 42 and one inner layer of two windings 43, 44. In FIG. 9A the axial width of the windings, normally adjacent, of the outer layer has been reduced in order to show more clearly the windings of the underlying inner layer. In fact, the two layers of windings substantially cover the same surface.

The reduction in the number of windings of the inner layer allows the width of the strip to be increased along the axis of the coil in relation to the corresponding width of the strip forming the windings of the outer layer.

According to a characteristic of the present invention, this increase results in a correlative increase in a capacitive effect and a reduction in the overall leakage inductance of the transformer, in accordance with one of the above-mentioned objects of the invention.

In fact, the inner layers of the coils are responsible for a portion of this leakage inductance which is even greater, since these layers are further away than the outer layers in the transformer. The enlargement according to the invention of the windings of the inner layers effectively attenuates that part of the leakage inductance caused by the distancing of these windings.

Clearly, this arrangement applies just as well to the winding of the rotating part as to that of the fixed part of the transformer according to the invention.

FIG. 9B shows the parts 12'*a*, 12'*b* of the conductor strip making up the coil 12', the part 12'*a* corresponding to the three windings 40 to 42 of the outer layer and part 12'*b* to the two windings 43, 44 of the inner layer.

The strip making up the winding 12' may be made very simply, according to the present invention, by cutting it out of a flat conductor such as a metal sheet, copper foil for example, in the asymmetrical V profile shown in FIG. 9B. The coil is thus made in a single piece, without requiring folding or soldering between the two layers of windings.

FIG. 9C an insulating sheet 10' interposed between the two layers unwound so as to be flat. The recesses 45, 46 permit this sheet to be passed through by the conductor strip.

FIGS. 10A to 10C are similar to FIGS. 9A to 9C respectively and show another embodiment of the rotary transformer according to the invention. In these figures, reference numerals, possibly marked with a "prime" or a "double prime", which are identical to the reference numerals in FIGS. 9A to 9C, refer to identical or similar elements or devices.

Thus the rotor coil 12" represented in FIG. 10A has two windings 50, 51 in the outer layer and one winding 52 in the inner layer. The axial dimension of this coil is advantageously smaller by one third than that of a coil with only one layer of three windings, with the same axial extension.

Generally speaking, the compactness of the coil is increased by arranging the windings in at least two layers. In the two-layer embodiment described above, with the widening of the winding of the inner layer, the compactness of the coil is advantageously increased without increasing the leakage inductance.

The unwound coil strip 12" represented in FIG. 10B shows the extension of the three windings. The unwound insulating sheet 10", represented in FIG. 10C shows the recesses 45', 46' having exactly the same function as that of the recesses 45, 46 of the embodiment shown in FIG. 9C.

In the application of the present invention to the space industry referred to above, the shaft 20 of the embodiment shown in FIG. 4, for example, could be connected to a support plate 21 of a measuring instrument 22, in a satellite for example, this plate requiring to be mounted rotatably in order to enable this instrument to be positioned in a reference location fixed by the stars. In such an application, the rotary transformer according to the invention advantageously replaces the brush commutators previously used merely because of its intrinsically greater reliability, which makes its "implementation" less costly.

Other characteristics also give it an advantage over rotary transformers of the prior art described in the preamble of the present description, the narrow interweaving of the coils considerably limiting leakage inductance and thus the associated losses.

The geometry of the rotary transformer according to the invention allows the gap to be very narrow and at the same time the section of the gap to be large. It is therefore possible to limit the reduction of the magnetising inductance and thus the magnetising current overload, a source of losses.

The transformer can therefore be highly efficient and transmit electrical power without excessive overheating.

Mounting the rotor on a ball bearing is extremely simple and the axial position of this bearing is unimportant. Only its centring is important.

Figure 6:
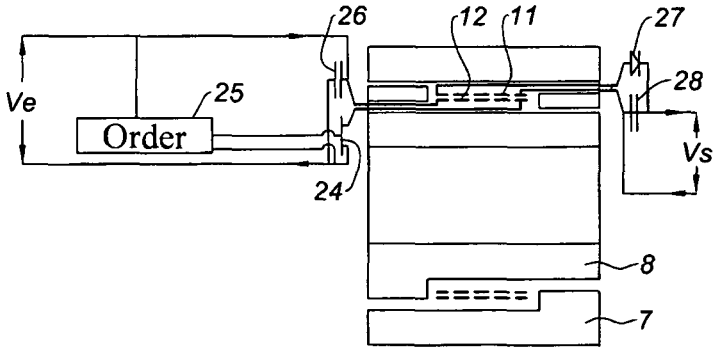
FIG. 6 represents an electrical power supply device, of the "flyback" converter type, incorporating a rotary transformer according to the invention.

Thanks to its very low leakage inductance, it is possible to envisage the introduction of the transformer according to the invention in a power supply device with a "flyback" converter, such as the one shown in FIG. 6 of the accompanying drawings. In the figure, the rotary transformer according to the invention, as represented in FIG. 3, can be seen, introduced into such a converter conventionally comprising, on its input side supplied by a continuous voltage Ve, a circuit for supplying the coil 12 passing through a transistor for cutting the input current at an appropriate command 25, a capacitor 26 being mounted in parallel on the coil 12 and the transistor 24.

On the output side, connected to the coil 11, there is also usually a diode 27 and a filtering capacitor 28 delivering a continuous voltage Vs. It is known that such cut-off supplies have a higher efficiency than that of linear supplies, with little power being dissipated into the transistor.

By connecting the above-mentioned electronic components as close as possible to the transformer according to the invention, a particularly compact and highly efficient continuous/continuous power transmitter is created.

Figure 7:
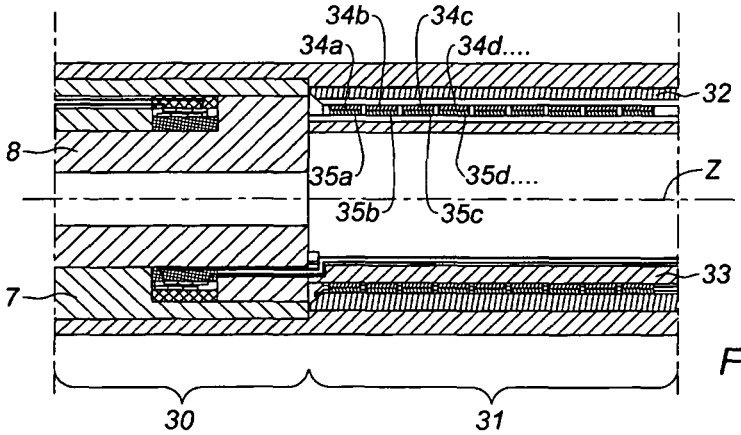
FIG. 7 is a schematic axial section of the connection of a rotary transformer according to the invention and a capacitive digital signal transmitter.

FIG. 7 shows a connection between a rotary transformer 30 according to the invention and a capacitive digital signal transmitter 31. Such transmitters comprising a fixed part 32 and a movable part 33 are known. These two parts are tubular and mounted coaxially one inside the other in such a way that the movable part 33 can rotate inside the fixed part. The parts 32 and 33 carry facing annular conducting tracks 34*a*, 34*b*, 34*c*, . . . and 35*a*, 35*b*, 35*c*, . . . respectively, designed to ensure the capacitive transmission of digital information.

By mechanically connecting the parts 7 and 8 of the transformer 30 to the parts 33 and 32 of the transmitter respectively, a single-unit device is constituted capable of transmitting, at the same time, electrical power to a measuring instrument mounted on a plate integral with the movable part of this assembly, and information exchanged between this instrument and a system for utilising the measurements taken by the instrument.

The invention is of course not limited to the embodiments described and shown which have been given purely by way of example, like the application to the space field. It may also be applied to supplying the rotors of synchronous dynamo-electric machines and, more generally, in any field where it is advantageous or necessary to transmit electrical power through an interface, without physical contact.

In this way a power connector could be created, made up, on the one hand, of the stator and associated coil embedded in an insulating layer and, on the other, of the rotor and associated coil also embedded in an insulating layer. An electrical connector is thus obtained in which the transfer of energy is achieved without any electrical contact. It can therefore be used in an explosive atmosphere. It eliminates any risk of electrocution when being connected or disconnected, for example, in order to charge the batteries of an electric vehicle.

The invention claimed is:

1. A rotary transformer for transmission of electrical power by electromagnetic induction between first (11) and second (12, 12', 12") coils concentrically arranged on first (7) and second (8) tubular parts, respectively, made of a ferromagnetic material and coaxially mounted in such a way that the outer surface (13*a*, 13*b*, 13*c*) of the first part can rotate facing the inner surface (14*a*, 14*b*, 14*c*) of the second part, each part having opposing axial ends, each inner and outer surface comprising two straight cylindrical rotation surfaces (13*a*, 13*c*) (14*a*, 14*c*) having different diameters, each extending from a different one of the opposing axial ends to an intermediate radial shoulder surface (13*b*, 14*b*) connecting the two straight cylindrical surfaces, said parts (7, 8) being arranged head-to-foot one inside the other so as to delimit, between said shoulder surfaces (13*b*, 14*b*), an annular space receiving said coils (11, 12, 12', 12") between two annular gaps each delimited by the facing cylindrical surfaces (13*a*, 14*a*) (13*c*, 14*c*) of said first (7) and second (8) parts, wherein each coil comprises only one layer of a plurality of windings, each winding having the form of a thin strip, and each coil is formed inside a metal ring by etching; wherein said layer of windings is fitted onto the part that carries it by means of a ring (9, 10) made of an insulating material, said layer of windings being directly glued onto the insulating ring (9,10).

2. The rotary transformer according to claim 1, wherein said layer of windings is covered externally by a layer of insulating material.

3. The rotary transformer according to claim 1, wherein the ratio of the axial lengths (L1, L2) of the two gaps is the inverse of that of their diameters (D1, D2).

4. The rotary transformer according to claim 1, wherein one (8') of said tubular parts (7', 8') is mounted rotatably within the other part (7') by means of a shaft (20') passing axially through said one part (8'), said shaft (20') having a chamfered root (20'*a*) fitting in a complementary manner into a chamfer (8'*a*) in said one part (8').

5. The rotary transformer according to claim 1, wherein the clearance (j) separating the facing coils (11, 12) is between 0.3 and 0.5 mm.

6. The rotary transformer according to claim 1, wherein the clearance (j) separating the facing coils (11, 12) is 0.4 mm.

7. The rotary transformer according to claim 1, wherein the ferromagnetic material is ferrite.

8. An electrical power supply device for an instrument (22) mounted on a rotary plate (21), comprising means of transmitting said power without physical contact between said plate (21) and a support thereof, wherein said means comprises the rotary transformer according to claim 1, the second tubular part (8, 8') of said transformer being integral in rotation with said plate (21).

9. The device according to claim 8, wherein said second tubular part (8, 8') of said transformer is also integral in rotation with a rotary part (33) of a capacitive digital signal transmitter.

10. An electrical power supply device of the "flyback" converter type comprising the rotary transformer of claim 1.

* * * * *